United States Patent [19]

Southworth

[11] 4,203,229

[45] May 20, 1980

[54] DRYER SYSTEM AND METHOD OF CONTROLLING THE SAME

[75] Inventor: Ronald W. Southworth, Atlanta, Ga.

[73] Assignee: Champion International Corporation, Stamford, Conn.

[21] Appl. No.: 838,561

[22] Filed: Oct. 3, 1977

[51] Int. Cl.[2] ..... F26B 21/10

[52] U.S. Cl. ..... 34/46; 34/48; 34/212; 34/216; 432/72; 432/222

[58] Field of Search ..... 34/30, 31, 46, 48, 212, 34/215, 216, 50; 432/24, 222, 72; 110/233, 20 B

[56] References Cited

U.S. PATENT DOCUMENTS

| | | | |
|---|---|---|---|
| 830,974 | 9/1906 | Decarie | 110/210 |
| 3,601,900 | 8/1971 | Erisman | 34/26 |
| 3,627,290 | 12/1971 | Grieve | 432/72 |
| 3,868,779 | 3/1975 | Wilt, Jr. et al. | 34/32 |
| 3,917,444 | 11/1975 | Carthew | 432/49 |
| 3,995,077 | 11/1976 | Hager | 34/9.5 |
| 4,017,254 | 4/1977 | Jones | 432/72 |
| 4,027,602 | 6/1977 | Mott | 110/203 |

*Primary Examiner*—Larry I. Schwartz
*Attorney, Agent, or Firm*—Evelyn M. Sommer

[57] ABSTRACT

The system for drying wood products includes a heat source for providing heated gases at a constant temperature. The heated gases are supplied to individual dryers through a common supply plenum connected to individual dryer inlet plenums. The system includes means for adding ambient air at the dryer inlet plenum to temper the heated gases so as to maintain a constant temperature at the dryer outlet while varying the dryer inlet temperature as a function of the amount of moisture to be removed.

6 Claims, 2 Drawing Figures

DRYER SYSTEM AND METHOD OF CONTROLLING THE SAME

BACKGROUND OF THE INVENTION

The present invention relates to dryers and more particularly to a dryer system for removing moisture from wood products and to a method for controlling the system.

In the manufacture of wood products such as particleboard, as an example, a manufactured product may contain a great deal of moisture either as a result of moisture retained in the constituents of that product or as a result of the addition of moisture in the course of manufacture. Dryer systems must be provided to remove that moisture in one step of the overall manufacturing process. It is, of course, desirable to maximize the use of waste wood products in generating heat for such dryers.

SUMMARY OF THE INVENTION

The present invention is a dryer system which includes a heat source for providing heated gases at a known constant temperature. Gases provided by the heat source are directed through a common supply plenum to individual dryer inlet plenums. The system includes means for adding ambient air at each dryer inlet plenum to maintain the dryer outlet temperature at a constant level while varying the inlet temperature as a function of the amount of moisture to be removed in the dryer.

DESCRIPTION OF THE DRAWINGS

While the specification concludes with claims particularly pointing out and distinctly claiming that which is regarded as the present invention, further details of a preferred embodiment of the invention may be more readily ascertained from the following detailed description when read in conjunction with the accompanying drawings wherein:

DETAILED DESCRIPTION

Figure 1:
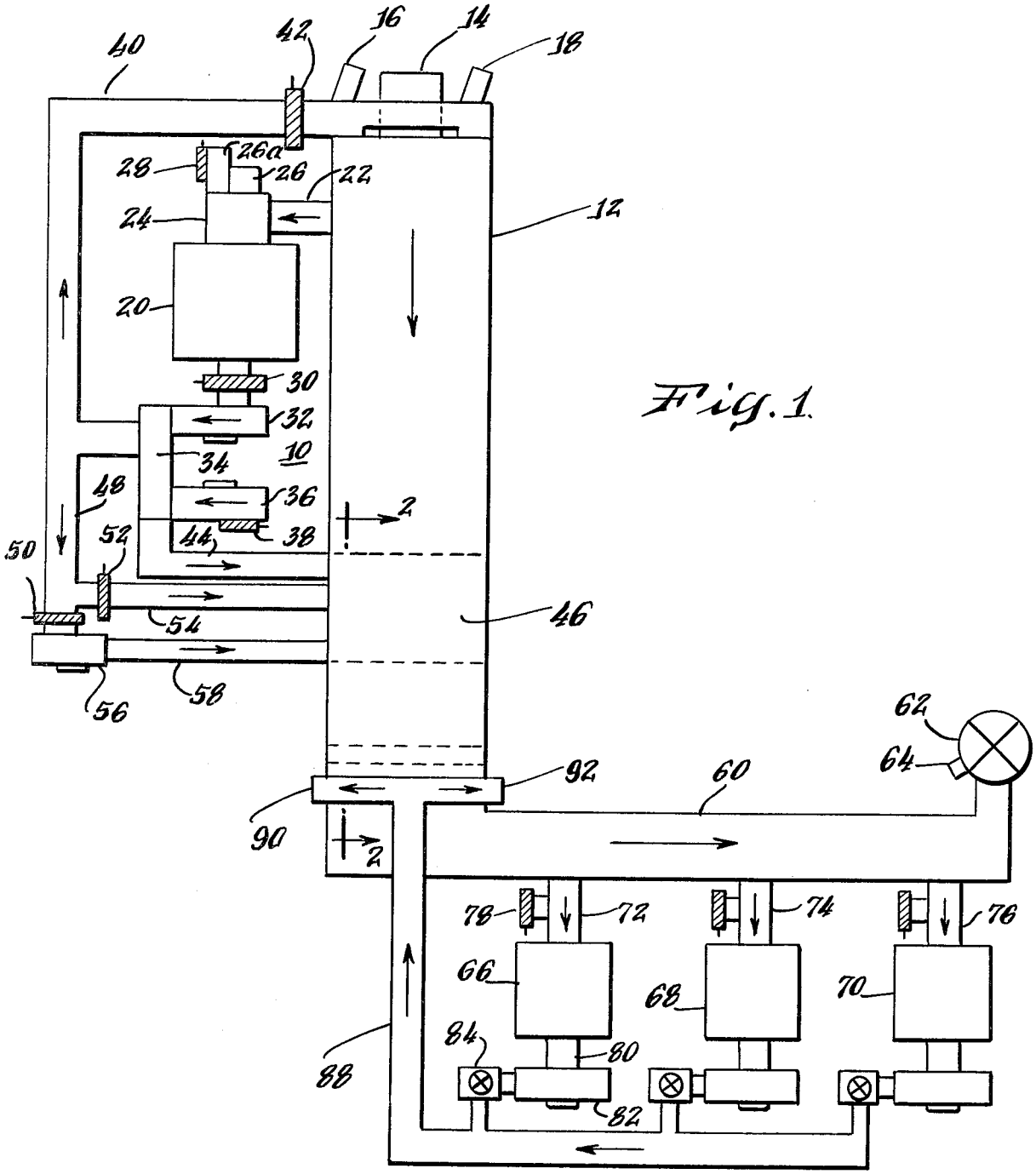
FIG. 1 is a schematic diagram of a dryer system which can be operated in accordance with the present invention.

Referring to FIG. 1, a dryer system constructed in accordance with the present invention has a heat source 10 capable of supplying heated gases at a known constant temperature. The heat source 10 includes a furnace 12 which burns pulverized wood fuel and hogged fuel, the latter being wood scraps and bark generally no greater than two inches in size. The hogged fuel is added to the furnace 12 through a stoker mechanism 14 while the pulverized fuel, including sander dust and wood fines, is added through inlets 16 and 18. The function of the furnace 12 is to produce a base rate of heating.

The heat source 10 further includes a boiler 20 which can burn wood dust or natural gas. The wood dust is supplied to a boiler dust burner 26. The burner is supplied with air provided by a secondary air fan 26A which receives heated ambient air through an adjustable secondary air damper 28. This burner is used only when furnace 20 is not operating. The volume of heated gases supplied via inlet mixing chamber 24 to boiler 20 through duct 22 is controlled by an adjustable damper 30 in an outlet duct leading from the boiler. The heated gases are forced by a boiler fan 32 through an air to air heat exchanger 34 where it is used to heat ambient air forced through the heat exchanger by a fan 36 having an adjustable inlet damper 38. A portion of the ambient air heated in chamber 34 is returned to the entrance of the furnace through a return duct 40 and adjustable damper 42 to the furnish secondary combustion air for burners 16 and 18. Gases from the boiler fan 32 then pass through a duct 44 to a furnace wall 46 shown only in phantom in FIG. 1. These gases pass from the wall into the mixing chamber. Details of the furnace wall construction will be provided later. Still more heated ambient air from chamber 34 is directed through duct 48 to the inlet side of adjustable dampers 50 and 52. Adjustable damper 52 controls the flow of air through a duct 54 to the furnace wall 46 for undergrate combustion air. Adjustable damper 50 controls the flow of air to an air fan 56 which forces heated air through a duct 58 to the furnace wall for overfire combustion air.

The function of the boiler and its associated outlet ducts is to produce steam for the drying process. The boiler exit gases are used to preheat combustion air and then to assist in tempering the hot gases from the furnace before they are used in the dryers.

The furnace gases are supplied to a supply plenum 60 which terminates in a control stack 62. The control stack 62 should be large enough to maintain a constant negative pressure in the heat source regardless of demands made upon the heat source during the drying of wood products. A stack thermocouple 64 is provided at stack 62 to monitor the temperature of the heated gases provided by heat source 10. The stack thermocouple is used to control the firing rate of the furnace system 12 to increase or decrease the heat contribution from the furnace system 12 as necessary to maintain a constant gas temperature at stack 62.

A number of dryers 66, 68 and 70 are connected to supply plenum 60 through dryer inlet plenums 72, 74 and 76, respectively. Each of the dryers is identical to the other. While only dryer 66 will be described in detail, it should be understood that the same description also applies to dryers 68 and 70.

The dryer inlet plenum 72 for dryer 66 receives heated gases from supply plenum 60 at a known constant temperature. The temperature at the inlet to dryer 66 can be adjusted by adding ambient air to the dryer inlet plenum through an adjustable damper 78. A dryer outlet plenum 80 for dryer 66 is connected to a fan 82 which draws heated gases from dryer 66 and applies those gases to a recycle skimmer and exhaust stack 84. Gases exhausted from the dryer 66 can be recycled to the heat source 10 through a return duct 88 connected to each of the dryers in the system. Recycled gases are distributed between ducts 90 and 92 which supply the recycled gases to inlets on opposite walls of the furnace 12.

Figure 2:
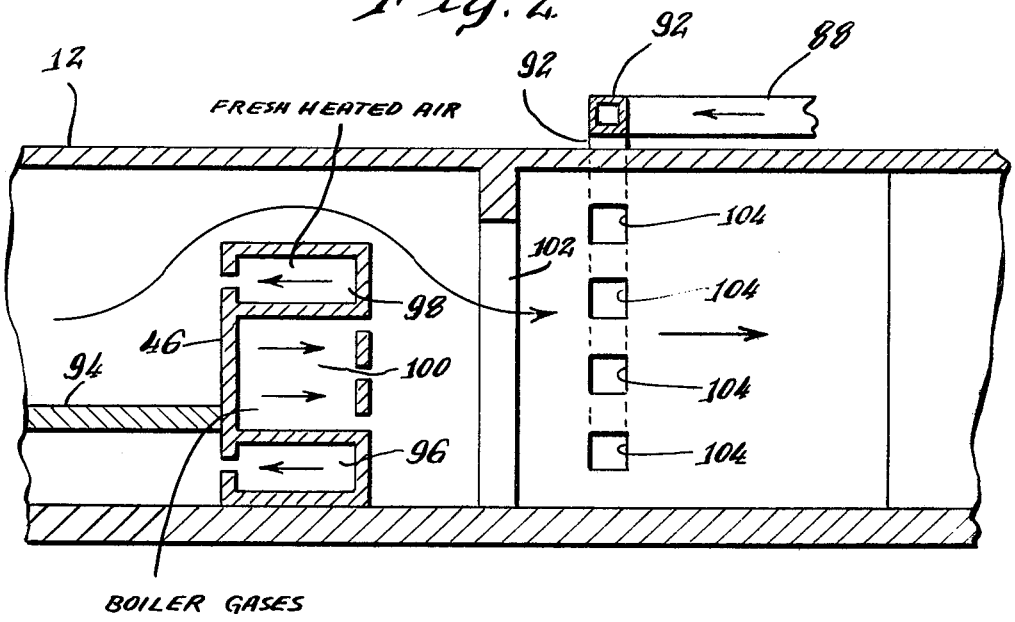
FIG. 2 is a partial cross-section taken along lines 2—2 of FIG. 1.

These inlets and other details of the interior of the furnace in the region of furnace wall 46 can be more clearly seen in FIG. 2. The furnace includes a grate 94 for receiving the wood fuel to be burned. Heated air provided by the boiler heat exchanger is directed beneath grate 94 from a chamber 96 in furnace wall 46. The chamber 96 is connected to duct 54 of the boiler heat exchanger. Over fire air is provided to furnace 12 from a chamber 98 connected to duct 58 of the boiler heat exchanger system. Duct 44 of the boiler system supplies boiler exhaust gases to an intermediate chamber 100. It will be seen that air supplied from chambers 96 and 98 flows counter to the general flow of air through furnace 12 while gases supplied from chamber 100 aids in that flow. To provide thorough mixing of heated air, the furnace outlet has a flow-constricting arch 102. Recycled gas inlets 104 are disposed vertically in the side walls of furnace 12 just downstream of the arch 102.

The temperature in the vicinity of the furnace wall 46 may range from 2,400° F. to 2,900° F. The recycled gases temper the heated gases to provide a temperature within supply plenum 60 in the range of 600° F. to 1,200° F.

In controlling each of the dryers in the system, the heat source 10 is treated as a separate entity, the only function of which is to provide heated gases at a known predetermined temperature at stack 62. The outlet temperature for each of the dryers is to be held at a constant known temperature while the inlet temperature for each dryer is varied as a function of the amount of moisture to be removed from wood products being dried. The dryer inlet temperature is varied by adding ambient air to the dryer inlet plenum to temper the heated gases provided by supply plenum 60.

There are three major calculations which can be performed in controlling dryers in accordance with this technique. The final temperature of heated gases produced by the heat source 10 must be calculated. The dryer inlet temperature and weight of gases which is needed to evaporate the necessary amount of moisture from wood products being processed in the dryer must also be calculated. The third major calculation is of the weight of ambient air which must be added to gases at the dryer inlet plenum in order to reduce the heat source temperature to the desired dryer inlet temperature.

The final temperature of the furnace 12 can be expressed as the temperature of the burning wood plus a temperature increment due to heating of gases within furnace 12 by excess heat. The total energy available from burning wood is a product of the heat value of that wood per pound and the number of pounds of wood burned. Since the dryer process is continuous, the number of pounds of wood burned and most other variables are expressed in terms of units per hour. For example, the amount of wood to be burned initially may be 2,000 pounds per hour on a dry basis. The term "dry basis" refers to the weight of the wood as if it contained no moisture. The actual weight of the wood to be burned will be somewhat heavier due to its moisture content. For purposes of these calculations, it is assumed that the number of BTU's available from burning a pound of dry wood is 8,700. Therefore, the total energy made available by burning 2,000 pounds of dry wood is 8,700 BTU's per pound times 2,000 pounds of dry wood per hour or 17.4 times $10^6$ BTU's per hour.

A part of this total available energy is required to raise the wood fuel to its combustion temperature. The total energy required for this purpose is a function of the rate at which wood is added to the furnace, the specific heat of wood, the temperature differential between the ambient temperature of the wood and its ignition temperature, the amount of moisture contained in the wood, the specific heats of water and steam, the latent heat of vaporization, the specific heat of air and the amount of air required for complete combustion.

If the amount of wood added to the furnace in pounds per hour is designated WF, the moisture content of that wood as a percentage of dry wood weight is designated as WM, the amount of air required for complete combustion of a pound of wood fuel is designated as A and the ambient temperature is designated as AT, the formula for determining the total BTU's (IB) required to bring the wood, moisture and air to the ignition temperature of carbon (which makes up 50% of the dry wood) can be expressed as $$IB = WF^* [0.42^* (1160 - AT) + WM^* (212 - AT) + 969.7^* WM + WM^* 0.48^* (1160 - 212) + A^*0.24^* (1160 - AT)] \quad (1)$$

where 0.42 is the specific heat of wood (in BTU/lb °F.)
1160 is the ignition temperature (F.°) of carbon,
212 is the boiling point of water,
969.7 is the heat of vaporization of water (per lb),
0.48 is the specific heat of steam, and
0.24 is the specific heat of air.

The amount of air (in pounds), required to support complete combustion of a pound of combustible material is given by the formula $$\frac{\text{Air (lb)}}{\text{Comb. (lb)}} = 11.52^*C + 34.56^* (H - O/8) \quad (2)$$

where

C is the decimal fraction of carbon per lb of combustible material.
H is the decimal fraction of hydrogen per lb of combustible material.
O is the decimal fraction of oxygen per lb of combustible material.

The chemical composition of oak and pine and their bark is 50.2% carbon, 6.1% hydrogen, 43.2% oxygen and 0.5% ash. Converting the percentages for carbon, hydrogen and oxygen to decimal fraction form, equation 2 becomes $$\frac{\text{Air (lb)}}{\text{Comb. (lb)}} = 11.52^* 0.502 + 34.56^*(0.061 - \frac{.432}{8}) = 6.0 \quad (3)$$

which means that 6.0 pounds of air are required for complete combustion of one pound of dry wood fuel. The amount of excess air which is provided to insure complete combustion may range from 20% to 100% of the required amount. An average amount of excess air would be 60% of the required amount or 3.6 pounds air per pound of dry fuel. If an average excess of 60% is assumed, the term A in Equation 1 can be established at 9.6 pounds of air. Since all of the terms of Equation 1 are either constants, measurable or otherwise known, the number of BTU's (IB) required to raise the wood fuel, moisture and air to 1160° F. can be computed.

To determine the temperature contribution to the final temperature of furnace 12 due to heating of gases in the furnace, the weight and specific heat of gases present in the furnace during combustion must be calculated. The total weight WG in pounds per hour of combustion gases produced upon the burning of wood fuel at 60% excess air is a function of the weight of dry wood burned, the total weight of combustion gases produced per pound of wood fuel, the weight of excess air during combustion and the moisture content of the wood fuel in pounds per pound of dry wood.

It is known that combustion of a pound of carbon in air generates 3.667 pounds of carbon dioxide plus 8.85 pounds of nitrogen while the burning of a pound of hydrogen in air generates 9.0 pounds of water plus 26.56 pounds of nitrogen. Therefore, upon burning a pound of dry wood, the below-listed amounts of carbon dioxide, water and nitrogen will be generated as a result of the combustion of carbon and hydrogen:

$$0.502 \frac{\text{lb C}}{\text{lb wood}} * 3.667 \frac{\text{lbs } CO_2}{\text{lb C}} = 1.840 \frac{\text{lb } CO_2}{\text{lb wood}} \quad (4)$$

$$0.006 \frac{\text{lb H}}{\text{lb wood}} * 9.0 \frac{\text{lb } H_2O}{\text{lb H}} = 0.54 \frac{\text{lb } H_2O}{\text{lb wood}}$$

$$0.502 \frac{\text{lb C}}{\text{lb wood}} * 8.85 \frac{\text{lb C}}{\text{lb N}} + 0.006 \frac{\text{lb H}}{\text{lb wood}} * 26.56 \frac{\text{lb N}}{\text{lb H}} = 4.595 \frac{\text{lb N}}{\text{lb wood}}$$

The total weights of the dry combustion gases per pound of dry wood calculated above are combined with the number of pounds of excess air (3.6) at 60% excess to produce a figure of 10.575 total pounds of gas per pound of wood.

Where natural gas is used as the fuel, 25.84 pounds of gas are produced per pound of natural gas.

The total weight of gases in pounds per hour includes not only the weight of the dry combustion gases and the weight of excess air but also the weight of moisture in the wood being burned. Where WF is the dry weight of wood fuel in pounds per hour, WM is the moisture content of that wood in pounds of moisture per pounds of dry wood, the total weight of heated gases can be computed as $$WG = WF*(10.575 + WM) \text{ lb/hr.} \quad (5)$$

The specific heat of the gases in the furnace during combustion is a proportional sum of the specific heats of the individual gases involved, including excess air. The proportional sum for each gas is the product of the specific heat of that gas and the weight of that gas produced per pound of dry wood fuel. The specific heats for the gases in the furnace are as follows:

$$\text{Specific heat of } CO_2 = 0.199 \frac{\text{BTU}}{\text{lb}} \text{ °F.} \quad (6)$$

$$\text{Specific heat of } H_2O \text{ (as steam)} = 0.480 \frac{\text{BTU}}{\text{lb}} \text{ °F.}$$

$$\text{Specific heat of N} = 0.248 \frac{\text{BTU}}{\text{lb}} \text{ °F.}$$

$$\text{Specific heat of air} = 0.241 \frac{\text{BTU}}{\text{lb}} \text{ °F.}$$

Referring to Equation 4 for the amounts of individual gases generated during the combustion of a pound of dry wood fuel and assuming that average of 3.6 pounds excess air exists, the total heat for the gases is $$\text{Total heat} = 1.84 * 0.199 + 0.54*0.48 + 4.595 * 0.248 + 3.6* 0.241 = 2.631 \quad (7)$$

and the total weight of those gases is $$\text{Total weight} = 1.84 + 0.54 + 4.595 + 3.6 = 10.575 \text{ lb} \quad (8)$$

The specific heat of the combined gases is the ratio of total heat to total weight or 2.631/10.575=0.248 BTU per pound °F. for dry wood fuel.

Adding 100% moisture to the fuel would increase the total weight of the gases by 1 pound per pound of fuel or to 11.575 pounds. The total heat in the gases would be increased by the proportional sum of the added moisture or by 1.0 times 0.48=0.480. Thus, the total heat would go from 2.631 to 3.111. The specific heat at 100% moisture would thus be 3.111/11.575 or 0.268. Since the specific heat will increase linearly from the minimum of 0.248 for dry wood fuel to the maximum of 0.268 for fuel with 100% moisture, the specific heat at any moisture content WM can be calculated as 0.248+0.02 WM.

The final temperature of the combustion gases, moisture and air in the furnace can be written as the sum of the temperature obtained upon burning of the wood fuel plus the temperature obtained upon heating of the combustion gases, moisture and air. As indicated above, the temperature obtained upon burning of wood is 1160° F. The temperature attained upon heating of the gases, moisture and air (TG) can be expressed as $$TG = \frac{8700*WF - IB}{WG\,(0.248 + 0.02\,WM)} \quad (9)$$

where the numerator represents the total heat available diminished by the amount of heat required in raising the temperature of the wood fuel, moisture and air to the carbon combustion temperature of 1,160° F. while the denominator is the product of the total weight of gases and the specific heat of those gases.

The final temperature TF in the furnace is thus equal to TG+1,160° F.

Once the final temperature attained in the furnace has been calculated and the dryer outlet temperature has been selected, the dryer inlet temperature can be calculated as a function of the amount of heat energy required to remove a given amount of moisture from a given amount of wood per hour and of the amount of heat energy required to change the temperature of the dryer gases to the specified dryer outlet temperature.

The amount of BTU's required to evaporate moisture from wood products in the dryer is a function of the number of pounds of wood products to be processed per hour, the moisture content of the wood products at the inlet and after drying, the selected dryer outlet temperature and the initial temperature of the wood products being processed. Where the initial or ambient temperature is below freezing (32° F.) the total number of BTU's (DB) required to evaporate moisture from the wood product can be expressed as $$DB = WR * MI * 0.49\,(32 - AT) + WR * MI * 142.9 + WR * MI * (DO - 32) + WR * (MI - MO) * 969.7 + WR * 0.42 * (DO - AT) \quad (10)$$

where

WR is the throughput of wood products in lbs/hr.

MI is the moisture content of the wood products at the dryer inlet as % of dry wood weight.

MO is the moisture content of the wood products at the dryer outlet as % of dry wood weight.

AT is the ambient temperature, which is less than 32° F.

0.49 is the specific heat of ice from −20° F. to 32° F.

142.9 is the heat of fusion of water.

969.7 is the heat of vaporization of water.

0.42 is the specific heat of wood.

In this equation, the first term represents the BTU's required to raise the temperature of ice in the wood to its melting point while the second term represents the heat required to actually melt the ice. The third term represents the heat required to raise the water from the freezing point to the dryer outlet temperature while the fourth term represents the energy required to vaporize the amount of water. The fifth term represents the energy required to heat the wood from the initial or ambient temperature to the dryer outlet temperature.

Equation 10 is materially simplified where the ambient temperature is above 32° F. since neither the specific heat of ice nor the heat of fusion is involved. Where the ambient temperature AT is greater than 32, the BTU's (DB) required for evaporation of moisture can be written as $$DB = WR * MI * (DO - AT) + WR * 0.42\,(DO - AT) + WR * (MI - MO) * 969.7 \quad (11)$$

The dryer inlet temperature must be set at a level which will not only cause the required amount of moisture to be evaporated but which will also change the temperature of gases within the dryer to the specified dryer outlet temperature. The amount of heat energy required to change the temperature of the dryer gases is a function of the weight of the inlet gases and the specific heat of those gases. The inlet weight of gases available to carry heat into the dryer is equal to the total weight of gases through the dryer minus the weight of water evaporated or $$IW = WT - WR*(MI - MO) \quad (12)$$

where

IW is weight of gases available at the dryer inlet to carry heat into the dryer in lbs/hr, WT# is the total weight of gases through the dryer in lbs/hr, and WR* (MI−MO) is the amount of moisture removed in lbs/hr.

Once the inlet weight IW of gases has been calculated, the dryer inlet temperature DI can be calculated as a function of the BTU's required to evaporate moisture, the weight and the specific heat of the inlet gases. The equation for the inlet temperature is $$DI = \frac{DB + (IW * 0.244 * DO)}{IW * 0.244} \quad (13)$$

where the term 0.244 is an average specific heat for inlet gases which will generally be a combination of furnace combustion gases and recycle gases.

Since the furnace combustion temperature will be much greater than the dryer inlet temperature, it is necessary to temper the furnace air by adding ambient air at the dryer inlet. The weight of ambient air WA required is a function of the weight of combustion gases, the specific heat of those gases, the amount of recycle gases being used, the specific heat of those recycled gases and the dryer inlet, dryer outlet and ambient temperatures.

WT=Weight of total gases out of the dryer and through the fan. Because it takes a specific volume and velocity to dry and convey the wood flakes in any specified dryer system, the gas volume out of the dryer and through the fan is predetermined and constant. In this particular case the gas volume has been set at 50,000 cubic feet per minute. We must convert this to pounds per hour.

60=60 min. per hr.

0.07488=Lbs. per cubic ft. of gas under standard conditions (60° F.)

50,000=Cubic ft. per minute out of the dryer (a constant)

520=Standard temperature degrees absolute

DO=Dryer outlet temperature °F.

460=Absolute zero

The amount of recycle gases (RC) employed starts at 0 and is increased in steps of 20% of the total gases through the dryer on the previous pass until the amount of ambient air added becomes less than 20%. The specific heat of the recycle gases (RH) has an initial value of 0.242. The specific heat value is increased by 0.005 for each 20% increase in the amount of recycled gases employed.

The equation for the weight of ambient air required to establish the dryer inlet temperature DI is:

$$WA = \frac{WG * 0.248 * (TF - DI) - RC*RH*(DI - DO)}{0.241 * (DI - AT)} \quad (14)$$

where RC is the amount of recycle gases in lbs/hr. All other terms are identified elsewhere.

The heat energy available within the dryer is a function of the temperature differential between the dryer inlet and the dryer outlet and of the weights and specific heats of ambient air, recycle gases and combustion gases. The available heat energy TB can be expressed as:

$$TB = (DI - DO) * (WA * 0.241) + (DI - DO) * (RC*RH) + (DI - DO) * WG * (0.248 + 0.02*WM) \quad (15)$$

While the preceding description has treated only a single dryer system, three or more dryer systems could utilize heat from the same heat source. Therefore, the capacity of the furnace and boiler in a practical system must be great enough to provide sufficient volumes of air at a constant temperature during conditions of maximum demand at all dryers in the system. Furnace air not actually delivered to the dryers is exhausted through the control stack for the system.

While there has been described what is considered to be a preferred embodiment of the invention, variations and modifications therein will occur to those skilled in the art once they become acquainted with the basic concepts of the invention. Therefore, it is intended that the appended claims shall be construed to include not only the disclosed embodiment but all such variations and modifications as fall within the true spirit and scope of the invention.

What is claimed is:

1. A dryer system for reducing the moisture content of wood products to predetermined levels comprising:

a heat source for producing heated gases having a known constant temperature, said heat source having at least one inlet for admitting fuel thereto and an outlet;

a control stack capable of maintaining a constant negative pressure in the heat source and a constant gas temperature at said stack;

a supply plenum connecting said outlet from said heat source to said control stack, said supply plenum being adapted to receive the heated gases from said heat source;

at least one dryer for receiving the wood products to be dried, said dryer having inlet and outlet plenums and being connected to said supply plenum through said dryer inlet plenum; and means for adding ambient air at said dryer inlet plenum to temper the heated gases so as to maintain a fixed temperature at the dryer outlet while varying the dryer inlet temperature as a function of the amount of moisture to be removed.

2. A dryer system as recited in claim 1 further including means for recycling exhaust gases from the dryer outlet plenum into said heat source.

3. A dryer system as recited in claim 1 wherein said means for adding ambient air at the dryer inlet plenum comprises an adjustable damper.

4. A dryer system as recited in claim 3 wherein said heat source comprises a furnace and means for supplying wood fuel to said furnace.

5. A dryer system for reducing the moisture content of wood products to predetermined levels comprising:

a heat source for producing heated gases having a known constant temperature, said heat source comprising a furnace, means for supplying wood fuel to said furnace, means of egress for said heated gases from said furnace, a boiler which can be heated by hot gases from said furnace, and means for supplying exhaust gases from said boiler to said furnace;

a control stack capable of maintaining a constant negative pressure in the furnace and a constant gas temperature at said stack;

a supply plenum connecting said means of egress from said furnace to said control stack, said supply plenum being adapted to receive the heated gases from said furnace;

at least one dryer for receiving the wood products to be dried, said dryer having inlet and outlet plenums and being connected to said supply plenum through said dryer inlet plenum; and damper means for adding ambient air at said dryer inlet plenum to temper the heated gases so as to maintain a fixed temperature at the dryer outlet while varying the dryer inlet temperature as a function of the amount of moisture to be removed.

6. A dryer system as recited in claim 5 further including means for recycling exhaust gases from the dryer outlet plenum to said furnace.

* * * * *